United States Patent [19]

Stein

[11] Patent Number: 4,784,165

[45] Date of Patent: Nov. 15, 1988

[54] EYELASH CURLER

[76] Inventor: Robert F. Stein, 2476 Glencoe Ave., Venice, Calif. 90291

[21] Appl. No.: 837,530

[22] Filed: Mar. 7, 1986

[51] Int. Cl.[4] ..... A45D 2/42

[52] U.S. Cl. ..... 132/217

[58] Field of Search ..... 132/31 A, 32 C, 79 D, 132/DIG. 3, 43 R

[56] References Cited

U.S. PATENT DOCUMENTS

| | | | |
|---|---|---|---|
| 1,951,130 | 3/1934 | Cohn et al. | 132/32 C |
| 2,129,755 | 9/1938 | Eisenman | 132/32 C |
| 2,252,742 | 8/1941 | Tuttle et al. | 132/32 C |
| 2,391,047 | 12/1945 | Tuttle et al. | 132/32 C |
| 2,411,519 | 11/1946 | Byron | 132/32 C |
| 2,481,448 | 9/1949 | Schiller | 132/43 R |
| 2,552,095 | 5/1951 | Hickey | 132/32 C |

FOREIGN PATENT DOCUMENTS

| | | | |
|---|---|---|---|
| 907936 | 3/1946 | France | 132/32 C |
| 945545 | 5/1949 | France | 132/32 C |
| 947341 | 6/1949 | France | 132/32 C |

*Primary Examiner*—Gene Mancene
*Assistant Examiner*—Cary E. Stone
*Attorney, Agent, or Firm*—Timothy T. Tyson

[57] ABSTRACT

An eyelash curler for use by one hand to curl eyelashes. The eyelash curler has an upper jaw with a curling bar member for placement on top of the eyelashes and a lower jaw with a resilient pad having a convex upper surface for placement under the eyelashes. Also included on the upper jaw is a lid guard projecting from the face of the curling bar member toward the eyelid when the curler is in position to curl the eyelashes. The lid guard keeps the eyelid out of the space between the jaws to prevent pinching of the eyelid and provides proper spacing of the jaws from the eyelid to allow optimal curling of the eyelashes. The upper jaw is coupled to a sleeve and the lower jaw is coupled to a plunger that slides inside the sleeve. Finger grips on the side of the sleeve and a thumb pad on the end of the plunger allow a three fingertip grip of the curler that optimally utilizes the characteristics of the hand to position the curler and curl the eyelashes.

7 Claims, 3 Drawing Sheets

EYELASH CURLER

BACKGROUND OF THE INVENTION

1. Field of the Invention

The present invention pertains to the toiletry art with respect to hair devices, and more particularly, to an eyelash curler.

2. Background Art

Numerous devices have been developed for curling or crimping eyelashes. The most popular eyelash curler currently available is illustrated in FIGS. 1 to 3. As shown in FIG. 2, the eyelash curler 10 is formed of wire into the shape of a scissors or pliers with a stationary member 12 and a moving member 14 that rotates about the stationary member 12 on an axle 16. Each member 12 and 14 has a finger grip 18 and 20, respectively, through which the thumb and the index finger of one hand are slipped to operate the curler 10. The curler 10 is positioned in front of the face 22 with the eyelashes 24 from the eyelid 26 of one eye 28 passing between the stationary jaw 30 and the moving jaw 32. The stationary jaw 30 is positioned either on or slightly away from the eyelid 26 and ideally does not move during the crimping operation. The eyelashes 24 are crimped when the finger grip 20 is moved toward the finger grip 18 forcing the moving member 14 to rotate on the axle 16 pushing a connector member 34 upward thereby pushing the moving jaw 32 upward against the stationary jaw 30. As shown in the enlarged sectional and partially cut away view of FIG. 3, the eyelashes 24 are trapped between the jaws 30 and 32 when the finger grips 18 and 20 are squeezed together. The stationary jaw 30 is a metal blade rectangular in cross section. The moving jaw 32 has a resilient firm rubber pad 36 also rectangular in cross section when not under compression. The stationary jaw 30 is welded to the stationary member 12. The moving jaw 32 includes a rigid metal carrier 38 welded to the connector member 34 and collars 40 and 42 on each end as shown in FIG. 1. The collars 40 and 42 retain the moving jaw 32 on the stationary member 12 allowing the moving jaw 32 to move up or down along the stationary member 12 as the finger grips 18 and 20 are pinched together or released. As the rectangular blade of the moving jaw 32 is pressed into the rubber pad 36, the rubber pad 36 compresses forming a square cornered "U". The eyelashes 24 are crimped at the two bottom corners of the "U" around the two bottom edges 44 and 46 of the stationary jaw 30. Crimping bends the eyelash shafts at sharp angles. When the eyelash curler 10 is removed, the eyelashes 24 retain the two bends or crimps giving the eyelashes an upward curved appearance.

Several problems are created by the design of the eyelash curler 10. Pinching of the eyelid 26 or other skin around the eye 28 often occurs between the stationary jaw 30 and the rubber pad 36 when the curler 10 is squeezed. The stationary jaw 30 is initially positioned with respect to the eyelid 26 by placing the inner side 48 of the stationary jaw 30 against the eyelid 26. The stationary jaw 30 is then moved slightly away from the eyelid 26. Alternatively, the stationary jaw 30 is positioned visually on the eyelashes 24. In either case, the eyelashes 24 are crimped as close as possible to the eyelid 26 in order to achieve the maximum lift on the outer ends 50. If the jaws 30 and 32 are too far away from the eyelid 26, little visible curling occurs. If the jaws 30 and 32 are too close, the rubber pad 36 may press the eyelid 26 against the stationary jaw 30 causing a painful pinch. The curler 10 may also pinch by catching a small portion of the eyelid at the inner or outer corners between the collar 42 and the stationary member 12 as indicated by the arrow 52 in FIG. 3 causing a pinch when the collar 42 moves up.

Maintenance of any set position of the stationary jaw 30 during the squeezing process is always a problem due to the scissors action of the curler 10 and the distance of the finger grips 18 and 20 from the jaws 30 and 32. The stationary jaw 30 is preferably kept at a single position slightly off the eyelid 26 during the crimping process. The position of the stationary jaw 30 is determined primarily by the position of the stationary finger grip 18 and secondarily by the moving finger grip 20 through the axle 16. During the scissors action, the natural tendancy of the hand is to move the finger grips 18 and 20 toward each other. The result is movement of the stationary jaw 30 away from the desired position. This problem is compounded by the distance between the finger grip 18 an the stationary jaw 30. Any movement of the finger grip 18 is magnified at the stationary jaw 30. Thus, for example, a small unintended rotation of the stationary finger grip 18 on the order of 5° during the squeezing process will easily move the stationary jaw 30 far from the eyelid 26 resulting in an unsatisfactory crimp of the eyelashes 24. On the other hand, over compensation for this operating characteristic of the curler 10 in the opposite direction can easily place the stationary jaw 30 against the eyelid 26 which may lead to a painful pinch.

The shapes of the jaws 30 and 32 and the scissors action may also cause pulling, over-curling, and cutting of the eyelashes 24. As illustrated in FIG. 3, during the crimping process the eyelashes 24 are trapped between the bottom of the rectangular stationary jaw 30 and the rubber pad 36. Most of the pressure between the two jaws 30 and 32 is focused between the bottom edges 44 and 46 and the rubber pad 36. The eyelashes 24 are therefore primarily held at these positions. Any movement of the stationary jaw 30 away from the eyelid 26 during the crimping process can easily result in the pulling of one or more eyelashes 24 from the eyelid 26. Excessive pressure between the jaws 30 and 32 may result in the over-curling or cutting of the eyelashes 24. Because both the bottom of the stationary jaw 30 and the top of the rubber pad 36 are flat, significant pressure is required to depress the top of the hard rubber pad 36 into the shape required to properly crimp the eyelashes 24. Inadequate pressure results in no crimping of the eyelashes 24. Excessive pressure results in the bottom edges 44 and 46 digging into the eyelashes 24 causing damage by excessive bending or cutting of the eyelashes. The cutting is caused by the sliding action between the bottom edges 44 and 46 and the squared sides of the depressed rubber pad 36 as the edges are pushed into the pad. The ideal pressure range to achieve a desired result is relatively narrow often causing the user to repeat the crimping process several times before a desire result is achieved.

Several devices have been developed to improve on the operation and results of the eyelash curler 10 illustrated in FIGS. 1–3. U.S. Pat. Nos. 2,393,848 to Wasserman; 2,584,668 to Brown; and 2,684,679 to Kisling all disclose eyelash curlers that adopt a plunger configuration avoiding some of the problems of the scissors design. All have flat profile upper jaws similar to the stationary upper jaw 30 of the previous embodiment. All have lower jaws with flat resilient pads. Wasserman also discloses another embodiment having a rigid lower jaw with a groove. Brown and Kisling also disclose other embodiments having lower jaws with a resilient pad having a "V" shape and a groove, respectively. Brown also discloses another embodiment having a lower jaw formed into a rigid metal "U" with the top of the "U" toward the upper jaw. A rubber tube is stretched around the "U" and is pressed into the top of the "U" by the upper jaw during the crimping process.

SUMMARY OF THE INVENTION

The present invention is directed to an improved eyelash curler having an upper jaw that is positioned on top of the eyelashes to be curled and a lower jaw that is positioned below the eyelashes. A means for spacing the upper jaw from the eyelid keeps the eyelid out of the space between the two jaws to prevent the pinching of the eyelid between the jaws. In a preferred embodiment, the means for spacing the upper jaw from the eyelid is a lid guard on the upper jaw projecting toward the eyelid.

In accordance with one important aspect of the invention, the upper jaw has a curling bar member and the lower jaw has a resilient convex pad member. The eyelashes are curled when the curling bar member and the resilient convex pad member are pressed together. The convex shape of the pad member minimizes the pressure required to achieve a desired curl of the eyelashes thereby also minimizing the possibility of overcurling, cutting, or pulling the eyelashes.

In accordance with another aspect of the invention, the pad member has a soft resilient center and a cleanable surface means. The center requires a relatively porous material in order to be soft. If unprotected, the pores tend to collect foreign objects. The cleanable surface means covers the porous center material with a non-porous material that is readily cleanable.

In accordance with another aspect of the invention, a three fingertip grip means is provided for the steady holding and operation of the eyelash curler by one hand. The three fingertip grip means utilizes the optimal dexterity of the hand by providing positions on the curler for the thumb, the index finger, and the middle finger. The position for the thumb tip is opposed to the positions of the finger tips. In a preferred embodiment, the three fingertip grips means includes a sleeve coupled to the upper jaw and a plunger coupled to the lower jaw. The plunger is slideably mounted in the sleeve with an end of the plunger extending out the bottom of the sleeve. Finger grips on opposite sides of the sleeve provide positions for the index and middle fingers to hold the curler. The thumb rests on the end of the plunger extending out the bottom of the sleeve. To operate the curler, the thumb pushes the plunger into the sleeve in a straight line between the two fingers forcing the lower jaw against the upper jaw and curling the eyelashes between the jaws. The three fingertip grip means allows the curler to be held securely and stably at all times, i.e. during the initial positioning of the eyelashes between the jaws, during the movement of the jaws together to curl the eyelashes, and during the holding of the jaws together on the eyelashes to allow the curl in the eyelashes to set.

Other features and advantages of the present invention will become apparent from the following detailed description, taken in conjunction with the accompanying drawings, which illustrate, by way of example, the principles of the invention.

DESCRIPTION OF THE PREFERRED EMBODIMENT

Figure 4:
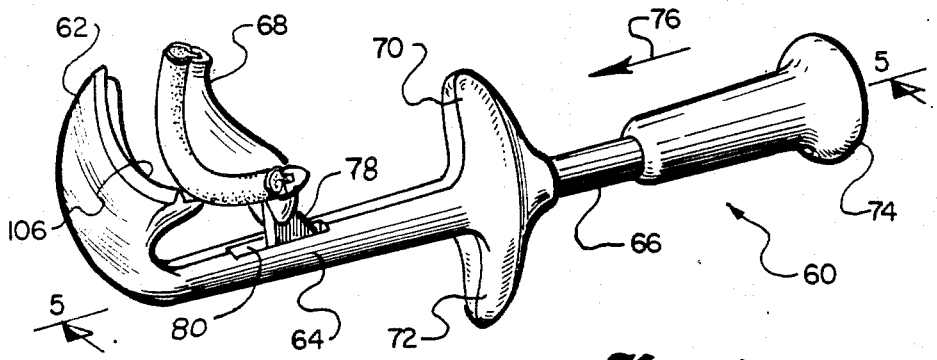
FIG. 4 is a perspective view of an eyelash curler of the present invention.

Referring intitially to FIG. 4, there is illustrated a perspective view of an eyelash curler, generally designated 60, in accordance with the present invention. The eyelash curler 60 has a upper jaw 62 coupled to a sleeve 64. Sliding inside the sleeve 64 is a plunger 66 carrying a rigid lower jaw 68. First and second finger grips 70 and 72 are mounted perpendicular to and on opposite sides of the sleeve 64. A thumb pad 74 is mounted on the end of the plunger 66. The eyelash curler 60 is operated by placing the index finger on the first finger grip 70, the middle finger on the second grip 72, and the thumb on the thumb grip 74. A three fingertip grip means of the eyelash curler 60 is thereby provided that utilizes the optimal dexterity of the hand and is comfortable and stable. The essential holding grip is achieved by the opposing relationship between the tips of the thumb and the two fingers, i.e. the tips of the index and middle fingers press on the finger grips 70 and 72 with the force exerted in straight lines toward the tip of the thumb on the thumb grip 74. The finger grips 70 and 72 comfortably accommodate any size of fingers and can be held anywhere along the lengths of the fingers. A maximum grip of the eyelash curler 60 is thereby assured within a minimum of effort. Optimal positioning of the curler 60 both initially at the eyelid - eyelash juncture and during the entire curling process is also assured by the three fingertip grip. The index and middle fingers and the thumb have the most dexterity of the fingers on the hand. The tips of these fingers also have greater positioning ability than other portions. When the greater positioning ability than other portions. When the plunger 66 is moved in the direction of the arrow 76 to close the lower jaw 68 on the upper jaw 62, the thumb tip moves toward the two other finger tips thus maintaining the same optimal three fingertip trip throughout the eyelash curling process.

Figure 1:
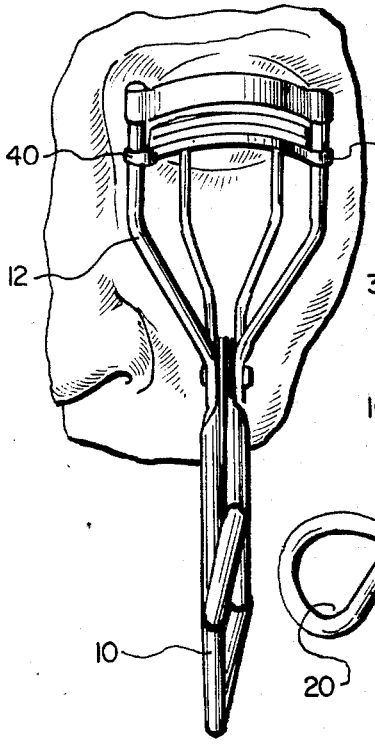
Fig.1. (PRIOR ART)
FIG. 1 is a front elevational view of a prior art eyelash curler.
Figure 2:
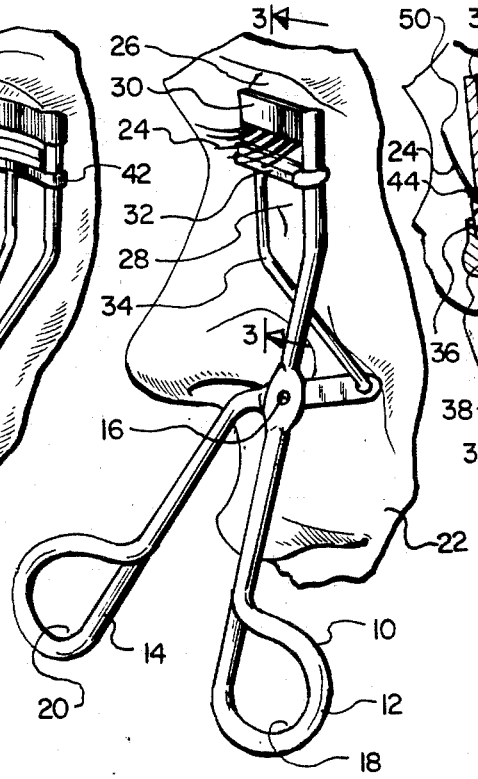
Fig.2. (PRIOR ART)
FIG. 2 is a side elevational view of the prior art curler of FIG. 1.
Figure 3:
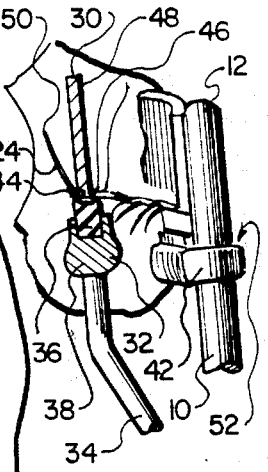
Fig.3. (PRIOR ART)
FIG. 3 is an enlarged sectional view along the line 3—3 of FIG. 2 with a break away of the related upper portion of the curler.

In comparison, the grips of the thumb and index finger on the enclosed finger grips 18 and 20 of the prior art eyelash curler 10 illustrated in FIG. 2 are usually unstable. A rigid grip of the curler 10 is only possible when the jaws 30 and 32 are closed on each other. Even then, the curler 10 may be easily rotated sideways on the thumb and finger by pushing the jaws 30 and 32 sideways. Any three point stability such as is inherent in the present invention is only achieved by the prior art eyelash curler 10 when the jaws 30 and 32 are firmly clamped on the eyelashes 24 and the eyelashes 24 themselves provide the third point. Even with this limited three point contact, the curler 10 remains unsteady and uncomfortable because of the samll finger grips 18 and 20 and the positions of the grips on the ends of the thumb and finger.

Figure 5:
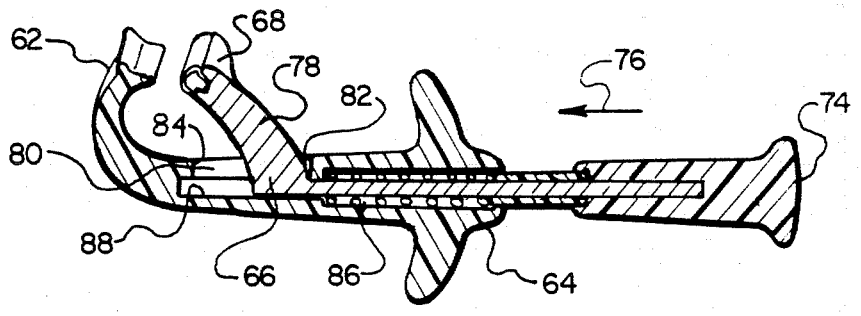
FIG. 5 is a reduced sectional view along the line 5—5 of FIG. 4.

The eyelash curler 60 is operated by placing the curler 60 in front of an eye with the eyelashes between the upper and lower jaws 62 and 68. The thumb is then used to push the plunger 66 into the sleeve 64 as indicated by the arrow 76. The lower jaw 68 is attached to the plunger 66 by an arm 78 that protrudes through the side of the sleeve 64 at a slot 80. FIG. 5 is a reduced sectional view along the line 5—5 of FIG. 4. The limits of movement of the arm 78 and the lower jaw 62 are therefore determined by the slot 80. For example, the jaws 62 and 68 are fully open when the arm 78 abuts the lower end 82 of the slot 80. The jaws 62 and 68 are fully closed as the arm 78 approaches the upper end 84 of the slot 80. Side movement of the arm 78 and the lower jaw 68 is limited by the sides of the slot 80. Minimal play is allowed between the sides of the arm 78 and the sides of the slot 80 in order assure alignment of the lower jaw 68 on the upper jaw 62 when the jaws are closed. Curling of the eyelashes occurs when the jaws 62 and 68 close on the eyelashes.

The arm 78 is normally held against the lower end 82 of the slot 80 by a biasing means in the form of a coiled compression spring 86. pressure by the thumb on the thumb grip 74 in the direction of the arrow 76 compresses the spring 86 as the plunger 66 moves along the bore 88 of the sleeve 64.

Figure 6:
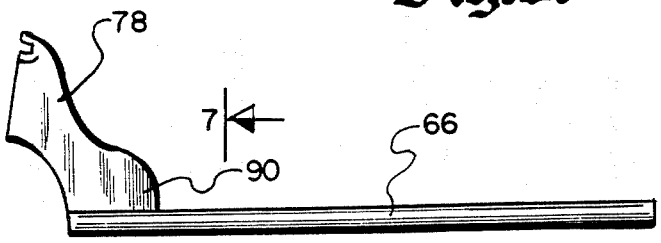
FIG. 6 is a side elevational view of the plunger.

FIG. 6 is a side elevational view of the plunger 66. A large bearing surface 90 on the arm 78 rides on the sides of the slot 80 (FIGS. 4 and 5) to maintain the alignment between the upper and lower jaws 62 and 68.

Figure 7:
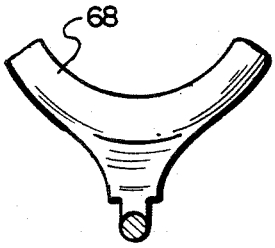
FIG. 7 is a sectional view along the line 7—7 of FIG. 6.

FIG. 7 is a sectional view along the line 7—7 of FIG. 6. The curvature of the lower head 68 matches the curvature of eyelashes on an eyelid.

Figure 8:
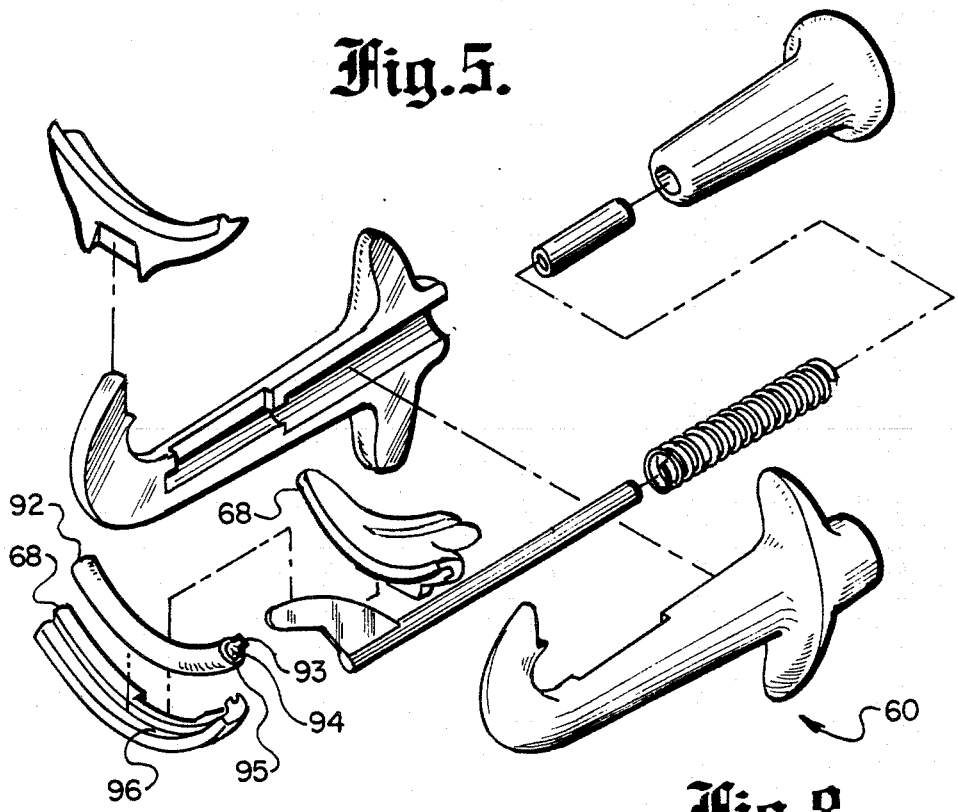
FIG. 8 is an exploded perspective view.

FIG. 8 is an exploded perspective view of the eyelash curler 60. A resilient pad member 92 is positioned on the lower jaw 68. The resilient pad member 92 is a cylinder with a tongue 93 along the bottom that is secured in a groove 96 in the top of the lower jaw 68. The resilient pad member 92 presents a convex surface 98 toward the upper jaw 62. The resilient pad member 92 is preferably fabricated with a soft foam center 94 and a smooth outer surface or skin 95. For example, the center 94 may be soft urethane foam and the skin 95 may be latex. The skin 95 provides a cleanable surface means that protects the porous foam center 94 from mascara, body oils, tears, eyeliner and other cosmetic products found around the eyes. The skin 95 is easily cleaned of these materials whereas the foam of the center 94 would tend to retain them without the presence of the protective skin 95.

Figure 9:
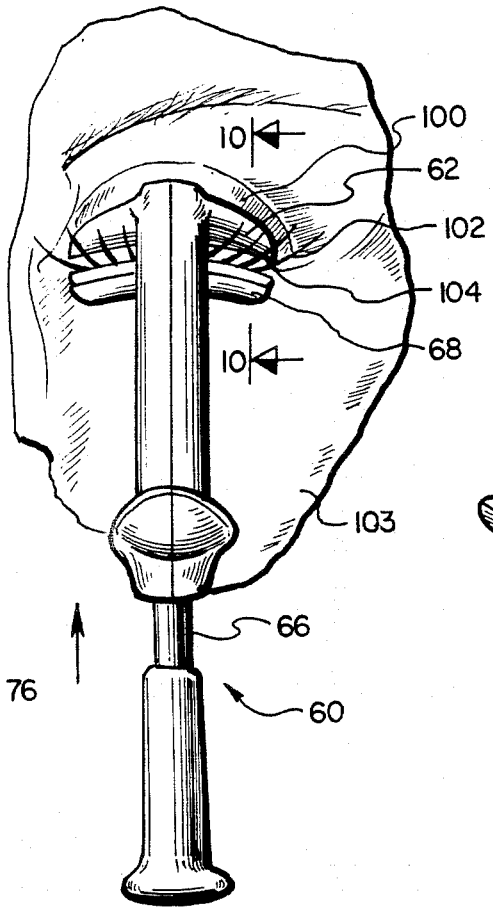
FIG. 9 is a front elevational view.

FIG. 9 is a front elevational view of the eyelash curler 60 positioned in front of an eyelid 100 ready to curl the eyelashes 102 passing between the upper and lower jaws 62 and 68. Movement of the plunger 66 to close the jaws 62 and 68 is in a single direction perpendicular to the eyelashes 102 indicated by the arrow 76. Any unecessary movement during the operation of the plunger 66 is, therefore, also perpendicular to the eyelashes 102 and parallel to the plane of the face 103. The most that can happen due to any unnecessary movement during the initial positioning is the start of the curl of the eyelashes 102 at a position further away from the eyelid 100 than is optimally desirable. Unlike crimping which puts sharp bends in the eyelash shafts, curling creates curves extending over a greater length of the shafts. If the curl is initially started at a position further away from the eyelid 100 than is desirable, the curler 60 is simply repositioned closer to the eyelid 100 and utilized again to start the curve closer to the eyelid. If the jaws 62 and 68 are already in the process of curling the eyelashes 102 when the movement occurs, the most that can happen is the movement of the eyelashes 102 with the eyelid 100 slightly up or down. Since the eyelid 100 readily moves up or down, little additional stress is placed on the eyelashes 102 that might result in the pulling of any eyelashes or any other damage to the eyelashes.

In comparison, the scissors action of the prior art eyelash curler 10 in FIG. 2 is in or out from the eyelid 26 and the plane of the face 22 with the result that excessive movement may lead to either the pinching of the eyelid 26 between the jaws 30 and 32, if the movement is toward the eyelid 26, or the pulling of one or more of the eyelashes 24 from the eyelid 26, if the movement is away from the eyelid 26.

Figure 10:
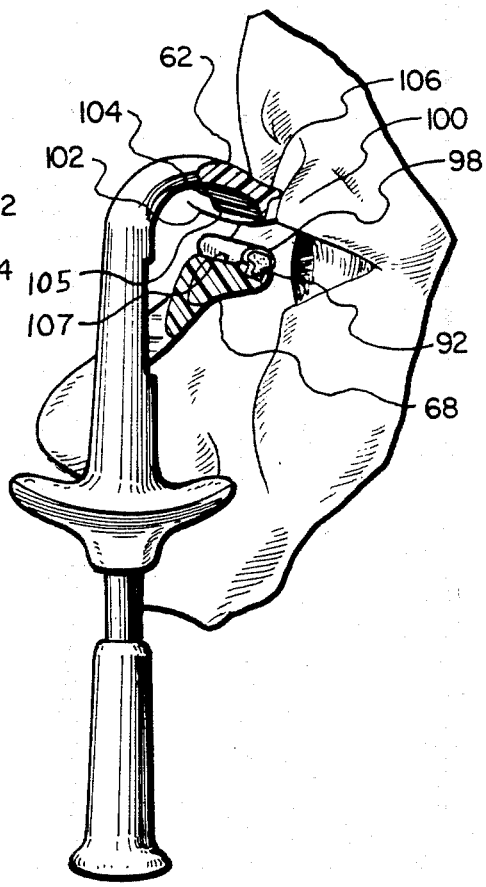
FIG. 10 is a sectional view along the line 10—10 of FIG. 9.
Figure 11:
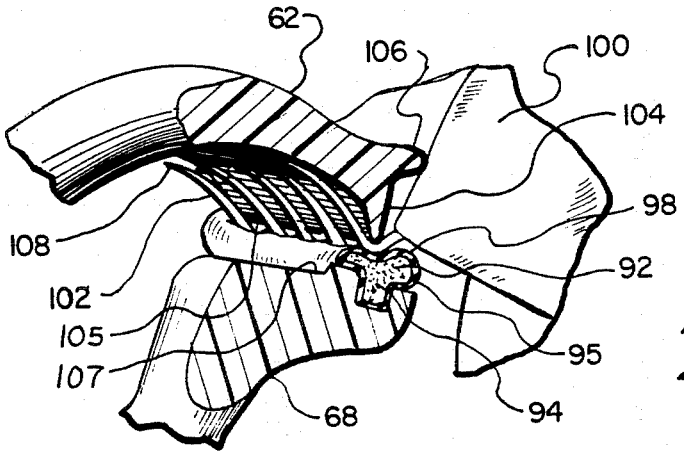
FIG. 11 is an enlarged sectional view of the jaws together.

FIG. 10 is a partial sectional view along the line 10—10 of FIG. 9. FIG. 11 is an enlarged sectional view similar to the portion of FIG. 10 in the jaw area with the upper and lower jaws 62 and 68 pressed together. The upper jaw 62 has a curling bar member 104 and a lid guard 106. The curling bar member 104 is positioned along the entire length of the upper jaw 62 (FIG. 9). The curling bar member 104 has a slightly rounded lower edge 105 providing a form around which the eyelashes 102 are bent. The upper surface 107 of the lower jaw 68 is parallel to the curling bar member 104. The lid guard 106 is a ridge running the length of the upper edge of the curling bar member 104 facing the eyelid 100 (FIG. 4). The ridge of the lid guard 106 parallels the edge of the curling bar member 104 along the entire length of the contoured face of the curling bar member 104. The lid guard 106 provides a means for spacing the upper jaw 62 from the eyelid 100 at an optimal location along the eyelashes 102 to achieve maximum lift of the eyelashes 102 when the eyelashes are curled. This optimal location for the curl is as close as possible to the eyelid 100. When the eyelashes 102 are curled at this position, the lift on the ends 108 of the eyelashes is as high as possible for a given curl angle. As shown in FIG. 10, the initial positioning of the upper jaw 62 on the eyelashes 102 is achieved by slipping the eyelashes 102 between the upper and lower jaws 62 and 68 until the lid guard 106 touches the eyelid 100 as shown in FIG. 10. The jaws 62 and 68 can then be closed curling the eyelashes 102 without pinching the eyelid 100. If the upper jaw 68 should happen to be moved inadvertently further toward the eyelid 100, the lid guard 106 physically keeps the eyelid 100 out of the space betwee the jaws 62 and 68. The increased pressure of the lid guard 106 on the eyelid 100 is immediately sensed by the user allowing corrective positioning to be made. If the upper jaw 62 is positioned too far away from the eyelid 100, the lid guard 106 does not make the proper contact and the lack of pressure on the eyelid 100 indicates to the user that the upper jaw 62 is not properly positioned and should be moved closer to the eyelid 100. If the eyelash curler 60 is being used by someone to curl the eyelashes of another, the lid guard 100 serves both as a physical bumper against the eyelid 100 and a visual indicator of the proper positioning of the upper jaw 62.

FIG. 10 illustrates the pad member 92 in an uncompressed situation with a normally convex upper surface 98. When the curler 60 is used, the convex upper surface 98 dents around the form of the lower edge 105 of the bar member 104 as shown in FIG. 11 as the lower edge is pressed into the pad member 92. Both the softness of the pad member 92 and the convex shape of the upper surface 98 of the pad member 92 contribute to the curling process. As noted above in conjunction with FIG. 9, the pad member 92 is fabricated with a soft porous foam center 94 protected by a skin 95. The center 94 allows the pad member 92 to press the eyelashes 102 into the curved form of the lower edge 105 of the bar member 104 without causing any damage to the eyelash shafts as occurs with harder pads. The convex upper surface 98 provides further advantageous characteristics not available with flat pads of previous eyelash curlers. The pressure required to form the pad member 92 around the shape of the edge bar member 104 is less than the pressure required to achieve the same set with a flat top pad of the same material because less lateral pad material is present in the pad member 92.

In view of the above, it may be seen that an eyelash curler is provided that significantly improves the eyelash curling procedure with greater safety and less difficulty. Of course, the structure may be variously implemented and variously used depending upon specific applications. Accordingly, the scope hereof shall not be referenced to the disclosed embodiment, but on the contrary, shall be determined in accordance with the claims as set forth below.

I claim:

1. An eyelash curler for curling eyelashes, comprising:

an upper jaw having a curling bar member with a lower edge;

a lower jaw having a rigid upper surface parallel to said curling bar member lower edge;

a cylindrical pad member fabricated of a uniformly resilient material and having:

a semi-circular cross section of a first diameter facing said lower edge; and a pad thickness substantially corresponding to said first diameter; and said rigid upper surface having a width substantially equal to said first diameter and supporting said resilient pad member; and hand operated means for pressing said lower edge into said pad member compressing said uniformly resilient material throughout said first diameter onto said rigid upper surface.

2. The eyelash curler according to claim 1 wherein said pad member further includes a cleanable surface means.

3. The eyelash curler according to claim 2 wherein said uniformly resilient material consists of foam.

4. The eyelash curler according to claim 3 wherein said cleanable surface means consists of a skin on said foam.

5. The eyelash curler according to claim 1 wherein said hand operated means for pressing said lower edge and said convex pad member together includes a three fingertip grip means for holding and operating said eyelash curler with one hand.

6. The eyelash curler according to claim 5 wherein said three fingertip grip means includes;

a sleeve coupled to one of said upper and lower jaws;

a plunger slideably mounted in said sleeve, extending out one end of said sleeve, and coupled to the other of said upper and lower jaws; and said sleeve having first and second finger grips on opposite sides of said sleeve.

7. The eyelash curler according to claim 1 wherein said upper surface includes a slot and said resilient cylindrical pad member is retained in said slot.

* * * * *